US008960566B2

(12) United States Patent
Leung

(10) Patent No.: US 8,960,566 B2
(45) Date of Patent: Feb. 24, 2015

(54) SPILL-PROOF DISPERSION DEVICE FOR DISPERSING VOLATILE LIQUIDS

(76) Inventor: Chi Nang Leung, Ma On Shan (HK)

( * ) Notice: Subject to any disclaimer, the term of this patent is extended or adjusted under 35 U.S.C. 154(b) by 288 days.

(21) Appl. No.: 13/545,305

(22) Filed: Jul. 10, 2012

(65) Prior Publication Data

US 2013/0134234 A1 May 30, 2013

(30) Foreign Application Priority Data

Nov. 28, 2011 (CN) ..... 2011 2 0480475

(51) Int. Cl.
*A24F 25/00* (2006.01)

(52) U.S. Cl.
USPC ..... 239/44; 239/34; 239/47; 239/145

(58) Field of Classification Search
USPC ..... 239/34, 44, 47, 211, 145
See application file for complete search history.

(56) References Cited

U.S. PATENT DOCUMENTS 3,587,968 A * 6/1971 Balland et al. ..... 239/47
4,621,768 A 11/1986 Lhoste et al.
2006/0081721 A1* 4/2006 Caserta et al. ..... 239/44
2010/0038442 A1 2/2010 Motylinski et al.
2010/0301128 A1* 12/2010 Pisklak ..... 239/44

FOREIGN PATENT DOCUMENTS

| | | | |
|---|---|---|---|
| CN | 2193340 | Y | 3/1995 |
| CN | 2242099 | Y | 12/1996 |
| CN | 24226812 | Y | 4/2001 |
| CN | 2610736 | Y | 4/2004 |
| CN | 2808632 | Y | 8/2006 |
| CN | 2823877 | Y | 10/2006 |
| FR | 2875137 | A1 | 3/2006 |

* cited by examiner

*Primary Examiner* — Steven J Ganey
(74) *Attorney, Agent, or Firm* — Wendy K. Marsh

(57) ABSTRACT

This invention provides a spill-proof dispersion device for dispersing volatile liquids, comprising a receptacle for containing volatile liquid therein and having an opening, at least one wick having an end placed in contact with the volatile liquid in the receptacle and for delivering the volatile liquid, and a diffuser in firm connection to the other end of the at least one wick and having a body with a surface from which the volatile liquid delivered from the wick is dispersed into an environment. The diffuser comprises a base located at its bottom and a sheath having a screwed outer surface and is sleeved tightly on an outer surface of the base; the base and the sheath are to be inserted into the opening of the receptacle such that the diffuser is engaged with the receptacle in an air-tight manner; and the wick runs through the base and the sheath.

12 Claims, 3 Drawing Sheets

SPILL-PROOF DISPERSION DEVICE FOR DISPERSING VOLATILE LIQUIDS

FIELD OF THE INVENTION

This invention relates to a dispersion device for dispersing volatile liquids such as fragrance compositions, and in particular, to a spill-proof fragrance dispersion device.

BACKGROUND OF THE INVENTION

Fragrance such as aroma compounds and natural essential oils are commonly known cosmetics. Dispersion devices for dispersing volatile liquids such as fragrance compositions and aroma compounds can disperse the fragrance to the atmosphere and are often arranged in home environments, hotel accommodations, bathrooms, and even mobile environments such as vehicles. Volatile liquids such as fragrance compositions usually can cause irritation to body parts (particularly to the eyes) and are also inflammable. Therefore, care must be taken when using the dispersion device for dispersing fragrance compositions to prevent them from spilling out if the fragrance dispersion device is tipped over or placed upside down, so as to avoid the possibility of causing injury to body parts or fire hazard.

Chinese patent no. ZL02250757.4 (Publication no. CN2610736Y) discloses a fragrance dispersing container comprising a container body, and a container cap which is made of gypsum and whose bottom surface has centrally a blind hole with inner screw threads. The container cap is screwed on the container body with a wick provided in the container cap and running through the blind hole to extend to the bottom surface of the container body. The container cap of the fragrance dispersing container is molded in the shape of flower with gypsum which has a good saturation level, and the fragrance composition is drawn by the wick via capillary action and saturated into each flower petal of the container cap, and from which the aroma of the fragrance composition is evenly dispersed into an environment, which gives the impression that the aroma is coming from actual flowers of the nature.

Although the above fragrance dispersing container can seal the fragrance composition in the container body by engaging the corresponding threaded surfaces of the container body and container cap to avoid spilling of the fragrance composition, the container cap and its inner threaded surface are not strong enough and the tightness of the above threaded engagement is of low degree due to the fact that the container cap is made of gypsum. Therefore, the container cap will easily be cracked or the connection will not be tight enough, and thus making the spill-proof function of the fragrance dispersing container ineffective.

As such, a fragrance dispersion device which is more effective in preventing the fragrance composition from spilling when tipped over is desirable.

SUMMARY OF THE INVENTION

An object of the invention is to overcome the above shortcomings of the prior art and provide a fragrance dispersion device which is more effective in preventing volatile liquids such as fragrance composition from spilling out of the device.

In order to achieve the above object, the present invention provides a dispersion device for dispersing volatile liquids, comprising a receptacle for containing volatile liquid therein and having an opening, at least one wick having an end placed in contact with the volatile liquid contained in the receptacle and for delivering the volatile liquid, and a diffuser in firm connection to the other end of the at least one wick and having a body with a surface from which the volatile liquid delivered from the wick disperses into an environment. The diffuser comprises a base located at its bottom having a cylindrical cork shape with one or more annular protrusions and a sheath sleeved tightly on an outer surface of the base, and the base and the sheath being configured to be matachable with the opening of the receptacle such that the diffuser is engaged with the receptacle in an air-tight manner, and the wick runs through the base and the sheath.

According to this invention, the diffuser and the receptacle form a sealed and integrated structure which not only improves the effectiveness of dispersing volatile liquid, but also prevents the spilling of the volatile liquid even if the dispersion device is tipped over or placed upside down. Thus, the fragrance dispersion device of the present invention increases the degree of safety during use, and prevents or minimizes, due to careless usages, the possibility of causing injury to body parts such as the eyes or the risk of fire hazard if the fragrance composition is spilled out.

DETAILED DESCRIPTION OF THE PREFERRED EMBODIMENTS

The characteristics and the advantages of the invention will be more apparent with reference to the following detailed description of the invention and its embodiments thereof in conjunction with the accompanying drawings. It should be understood that the realization of the present invention does not limited to the below described embodiments. Those skilled in the art should comprehend the present invention according to the concepts illustrated in the following embodiments. Various technical terms should be understood in their most generic senses based on the concepts and principles of the present invention. In the various figures of the drawings, like reference numbers are used to designate like parts.

The present invention will be described in details below with reference to the preferred embodiments and the accompanying drawings.

Figure 1:
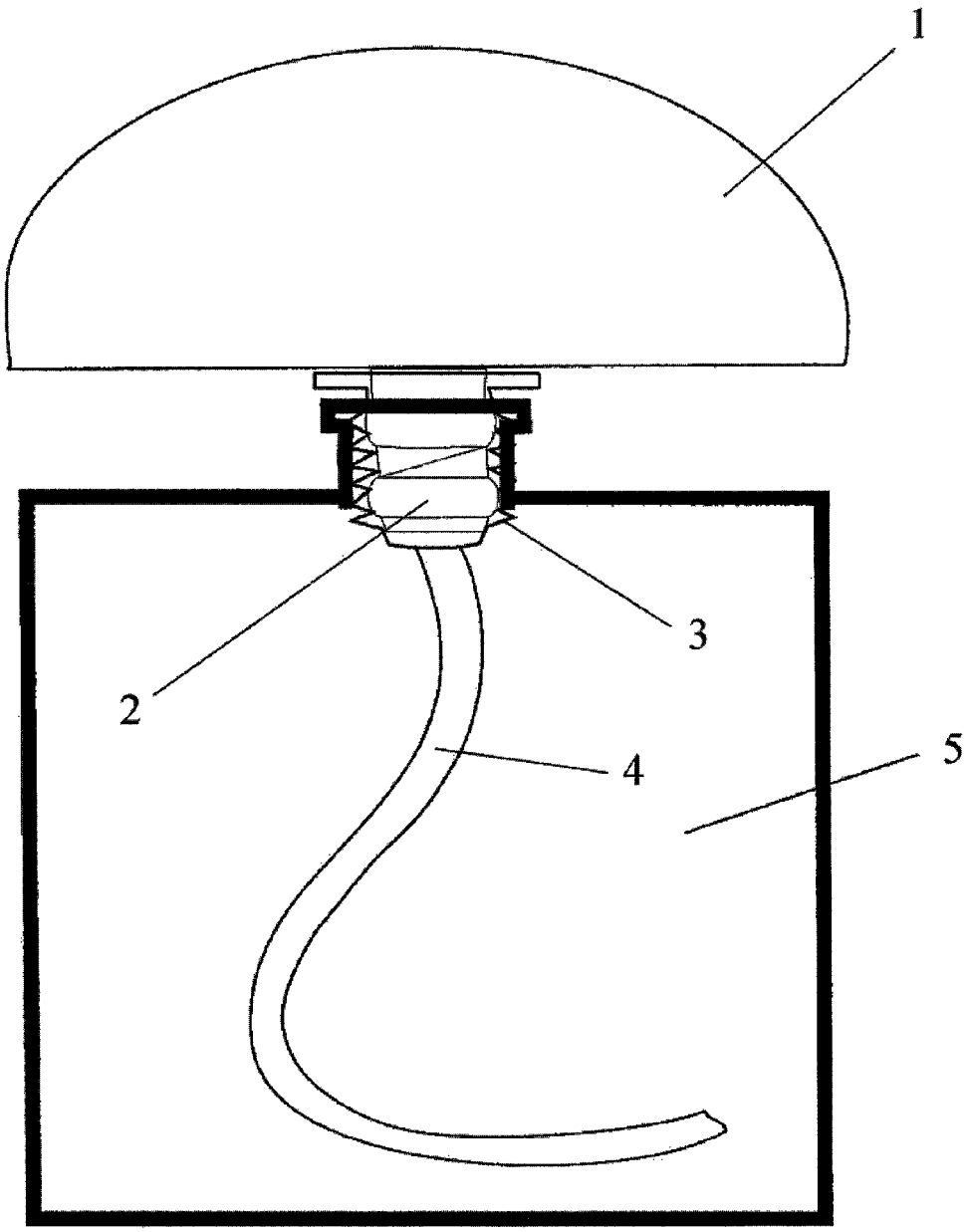
FIG. 1 shows a cross-section view of a fragrance dispersion device according to the present invention with the diffuser engagable with the receptacle.

Referring to FIG. 1, there is illustrated a fragrance dispersion device constructed according to an embodiment of this invention in cross-section, in which a diffuser 1 is engaged with a receptacle 5 where volatile liquid such as fragrance composition is to be contained.

Figure 2:
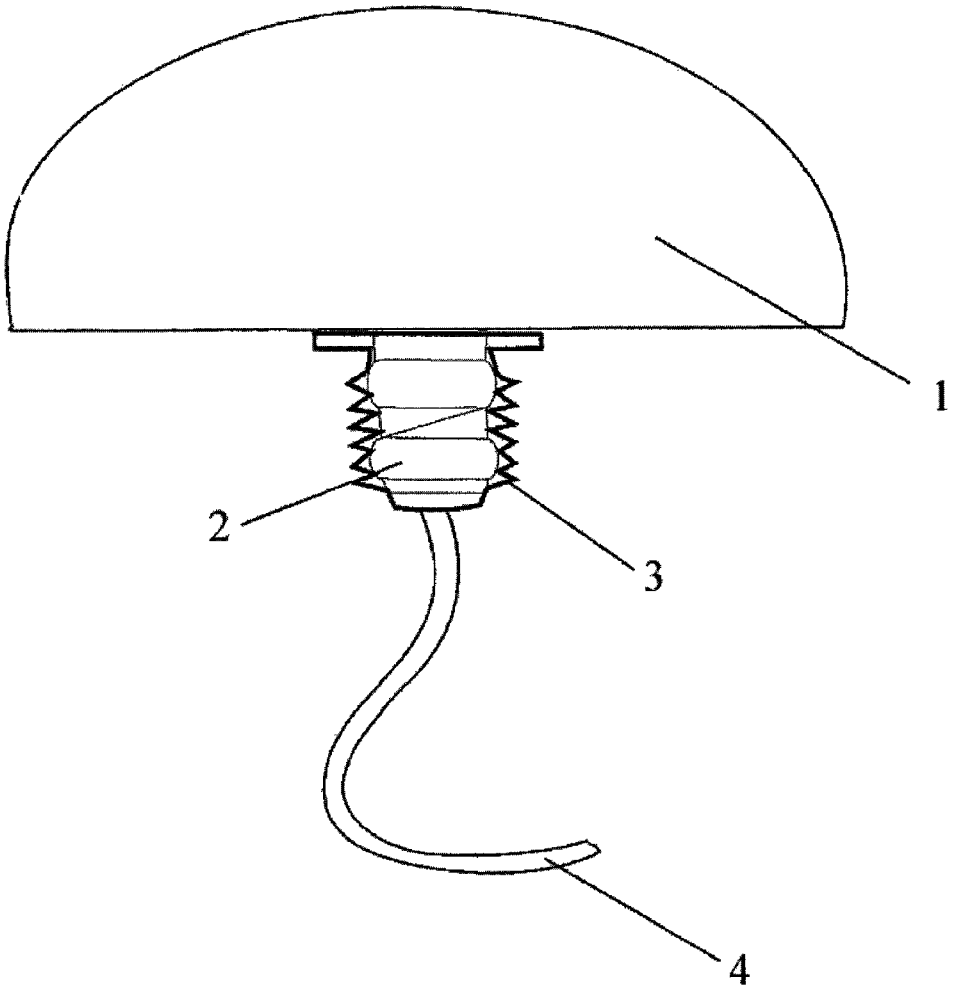
FIG. 2 shows a cross-section view of the diffuser of the fragrance dispersion device shown in FIG. 1, which comprises a threaded base located at its bottom and a wick connected to it.
Figure 3:
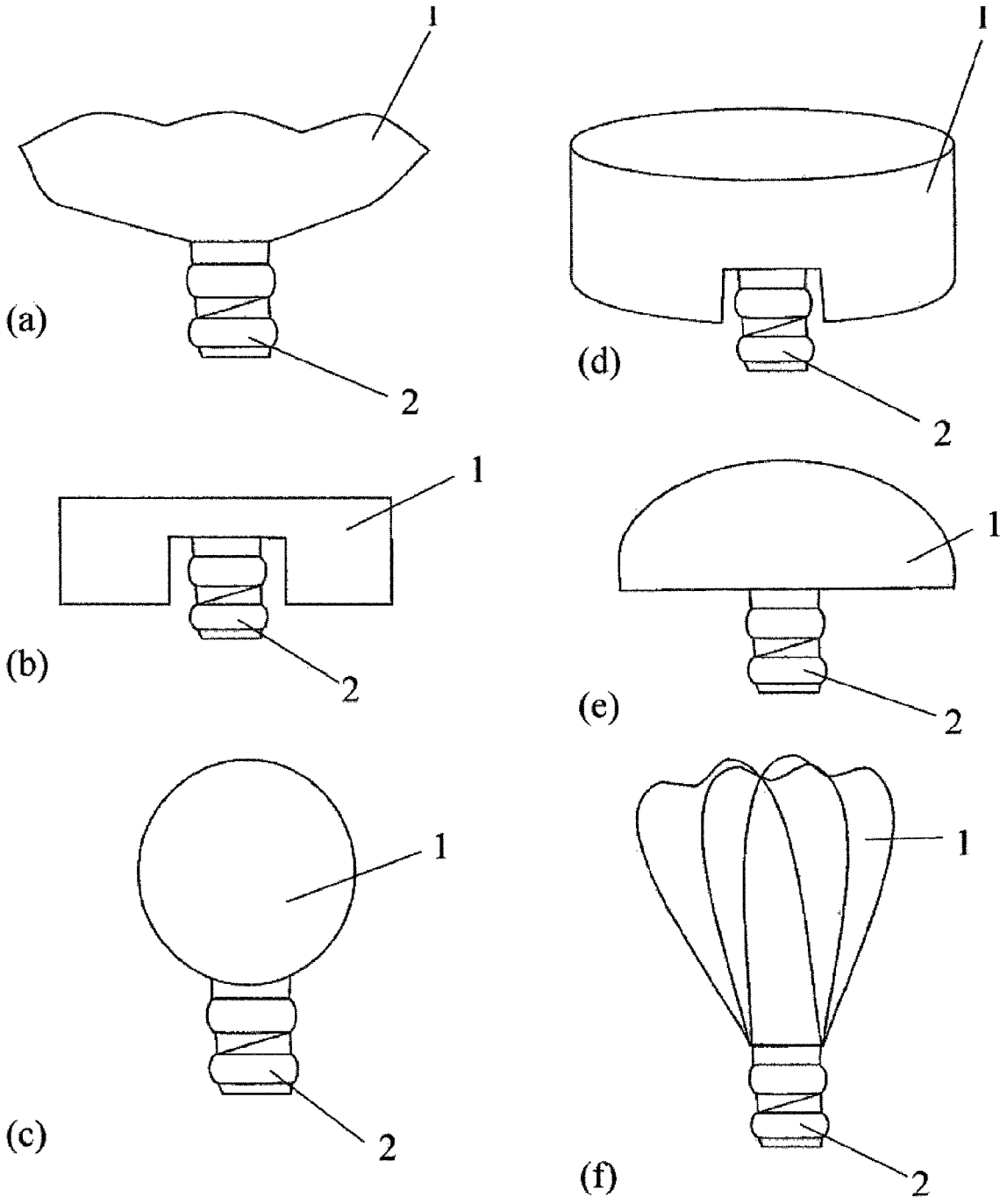
FIGS. 3(*a*)-3(*f*) show cross-section views of various embodiments of the diffuser of the fragrance dispersion device of the present invention, with the wick being removed.

As illustrated in FIG. 2, the diffuser 1 can be made of ceramic material and having a shape of a flower, for example. Volatile liquids such as fragrance composition can be saturated into the ceramic material and from where the volatile liquids can disperse into an environment from the surface of the ceramic material. FIGS. 3(*a*) to 3(*f*) show various embodiments of the shapes of the diffuser 1, and certainly the diffuser can also have any other shape which is appropriate.

The diffuser 1 comprises a base 2 located at its bottom and having a cylindrical cork shape with one or more annular protrusions. The diffuser 1 and the base 2 can be molded with a same material or different materials, and the computed-controlled lathe can be used for processing the flower petals of the ceramic diffuser and the protrusions of the base 2. The base 2 and the body of the diffuser 1 can be formed integrally, or they can be formed separately and afterwards secured together by adhesion or by embedding the base into the body. An end of a wick 4 can be connected firmly to the ceramic diffuser 1 simultaneously while molding and/or processing the diffuser 1, or the connection can be done subsequently. Another end of the wick 4 can be placed casually in the receptacle 5 (as illustrated in FIG. 1) to contact the volatile liquid.

Afterwards, a sheath 3 can be tightly sleeved onto an outer surface of the base 2 of the finished ceramic diffuser 1, so that it will not be easily shifted, and the wick 4 runs through the base 2 and the sheath 3. The sheath 3 can be made of plastic materials, and for example formed in a cylindrical shape with an inner surface which is flat or matches with the protrusions of the base 2. The sheath 3 is formed to have an outer surface which is threaded for inserting into the opening of the receptacle 5 so that the diffuser 1 and the receptacle 5 are engaged with each other in an air-tight manner. The wick 4 runs through the sheath 3. The sheath 3 can be made of elastic or flexible plastic materials, the ceramic diffuser 1 can be made of harder material than the sheath, and the base 2 and the receptacle 5 can be made of material which is relatively hard such as plastic or glass.

Thereafter, the base 2 and the sheath 3 that is sleeved onto the base can be inserted together into the opening of the receptacle 5 where volatile liquid such as fragrance composition is contained. The receptacle 5 can be made of glass or plastic, with its opening being ground or smooth, or threaded to match with or correspond to the threaded sheath 3. By inserting or screwing the sheath 3 into the opening of the receptacle 5, the ceramic diffuser 1 can be tightly engaged with the receptacle 5 since the sheath is elastic or flexible. The wick 4 delivers the volatile liquid to the diffuser, and the volatile liquid disperses onto the surface of the diffuser 1 and then slowly disperses to the environment.

Since the diffuser 1 and the receptacle 5 are tightly engaged with each other through the sheath 3, the volatile liquid in the receptacle 5 will not be spilled out even when the dispersion device is tipped over or placed upside down. In addition, the sheath 3 will not obstruct the wick 4 in delivering the volatile liquid to the diffuser 1.

According to this invention, the wick 4 delivers the volatile liquid such as fragrance composition to the surface of the diffuser 1 and from where the volatile liquid disperses to the environment, thus providing a safe and effective way of dispersing volatile liquid. Furthermore, the base 2 of the diffuser 1 in cork shape allows for providing a spill-proof fragrance dispersion device.

A significant feature of the fragrance dispersion device of the present invention is the integrated structure of the body and the base 2 of diffuser 1 (made of ceramic liquid), in which the base 2 is shaped as cylindrical cork, sleeved with the matching threaded elastic plastic sheath 3. This feature produces the following effects: (1) the base 2 acts as a cork which prevents the volatile liquid (such as fragrance composition) from spilling out or leaking; (2) through the capillary action by the wick 4, the volatile liquid is delivered to the surface of the diffuser (made of ceramic liquid) and then disperses to the environment.

In the fragrance dispersion device of the prevent invention, the spill-proof cork structure is formed by the body of the ceramic diffuser 1, the base 2 of the diffuser and the sheath 3 integrally connected to function as a cork, which is unlike the prior art devices in terms of structure and materials, yet still maintains the functions of delivering fragrance composition via capillary action and dispersing or evaporating the fragrance composition.

The dispersion device of the present invention can find applications in dispersing volatile liquids of low emission rate, for example using it as an aroma diffuser in home environments or in vehicles, and as a fragrance dispersion device, etc. The air-tight and integrated design of the diffuser and the receptacle increases the effectiveness of the dispersion of volatile liquid, and the spill-proof cork-shaped structure also increases the degree of safety when using the device, preventing or minimizing the possibility of causing injury to body parts such as the eyes due to careless usages or causing fire hazard if the device is tipped over.

The principles and structures of the present invention with reference to the preferred embodiments herein are intended as exemplary fragrance dispersion devices. It will be appreciated by those skilled in the art that the present invention is not limited to the embodiments illustrated. Those skilled in the art will envision many other possible variations and modifications by means of the skilled person's common knowledge without departing from the scope of the invention; however, such variations and modifications should fall into the scope of this invention.

What is claimed is:

1. A dispersion device for dispersing volatile liquids comprising:

a receptacle (5) for containing volatile liquid therein and having an opening;

at least one wick (4) having an end placed in contact with the volatile liquid in the receptacle and for delivering the volatile liquid; and a diffuser (1) in firm connection to the other end of the at least one wick, said diffuser having a body with a surface from which the volatile liquid delivered from the wick disperse into an environment;

wherein the diffuser comprises a base (2) located at its bottom and a sheath (3) sleeved tightly on an outer surface of the base, the base and the sheath being configured to be matchable with the opening of the receptacle such that the diffuser is engaged with the receptacle in an air-tight manner, and the wick runs through the base and the sheath;

wherein the sheath having an annular flange for limiting downward displacement of the sheath with respect to the receptacle, and the sheath does not obstruct the wick in delivering the volatile liquid to the diffuser.

2. The dispersion device as claimed in claim 1, wherein the base has a cylindrical cork shape with one or more annular protrusions.

3. The dispersion device as claimed in claim 1, wherein the diffuser is made of ceramic liquid.

4. The dispersion device as claimed in claim 1, wherein the sheath is made of elastic or flexible plastic.

5. The dispersion device as claimed in claim 1, wherein the receptacle is made of glass or plastic.

6. The dispersion device as claimed in claim 1, wherein the body and the base of the diffuser are formed integrally.

7. The dispersion device as claimed in claim 1, wherein the body and the base of the diffuser are formed separately and are secured together by adhesion or by embedding the base into the body.

8. The dispersion device as claimed in claim 1, wherein the sheath is of cylindrical configuration with an inner surface which is flat or matches with the protrusions of the base.

9. The dispersion device as claimed in claim 1, wherein the sheath is threaded on its outer surface.

10. The dispersion device as claimed in claim 1, wherein the opening of the receptacle is ground or smooth, or threaded to match with or correspond to the sheath.

11. A dispersion device for dispersing volatile liquids comprising:

a receptacle (5) for containing volatile liquid therein and having an opening;

at least one wick (4) having an end placed in contact with the volatile liquid in the receptacle and for delivering the volatile liquid; and a diffuser (1) in firm connection to the other end of the at least one wick, said diffuser having a body with a surface from which the volatile liquid delivered from the wick disperse into an environment;

wherein the diffuser comprises a base (2) located at its bottom and a sheath (3) sleeved tightly on an outer surface of the base, the base and the sheath being configured to be matchable with the opening of the receptacle such that the diffuser is engaged with the receptacle in an air-tight manner, and the wick runs through the base and the sheath;

wherein the sheath having an annular flange for limiting downward displacement of the sheath with respect to the receptacle, and the sheath does not obstruct the wick in delivering the volatile liquid to the diffuser wherein the base has a cylindrical cork shape with one or more annular protrusions.

12. A dispersion device for dispersing volatile liquids comprising:

a receptacle (5) for containing volatile liquid therein and having an opening;

at least one wick (4) having an end placed in contact with the volatile liquid in the receptacle and for delivering the volatile liquid; and a diffuser (1) in firm connection to the other end of the at least one wick, said diffuser having a body with a surface from which the volatile liquid delivered from the wick disperse into an environment;

wherein the diffuser comprises a base (2) located at its bottom and a sheath (3) sleeved tightly on an outer surface of the base, the base and the sheath being configured to be matchable with the opening of the receptacle such that the diffuser is engaged with the receptacle in an air-tight manner, and the wick runs through the base and the sheath;

wherein the sheath having an annular flange for limiting downward displacement of the sheath with respect to the receptacle, and the sheath does not obstruct the wick in delivering the volatile liquid to the diffuser;

wherein the body and the base of the diffuser are formed separately and are secured together by adhesion or by embedding the base into the body.

* * * * *